United States Patent [19]

Ingouf

[11] 4,324,192

[45] Apr. 13, 1982

[54] DEVICES FOR SETTING A SAIL

[76] Inventor: Pierre Ingouf, 131, rue de la Santé, Paris, France, 75013

[21] Appl. No.: 91,133

[22] Filed: Nov. 5, 1979

[30] Foreign Application Priority Data

Nov. 7, 1978 [FR] France ..... 78 32049

[51] Int. Cl.[3] ..... B63H 9/04

[52] U.S. Cl. ..... 114/106

[58] Field of Search ..... 114/39, 98, 99, 102, 114/103, 104, 105, 106–109, 111–112

[56] References Cited

U.S. PATENT DOCUMENTS 3,260,230 7/1966 Kauert ..... 114/106

3,285,215 11/1966 Potter ..... 114/102

3,608,511 9/1971 Katshen ..... 114/106

3,851,609 12/1974 Stearn ..... 114/105

3,948,200 4/1976 Hood et al. ..... 114/105

*Primary Examiner*—Trygve M. Blix

*Assistant Examiner*—Jesús D. Sotelo

*Attorney, Agent, or Firm*—Bacon & Thomas

[57] ABSTRACT

Fittings for ships, in particular for sailships. The device is characterized in that it comprises, for sliding and support of a bolt rope, a bolt rope tunnel extending between the top of the mast and the point of a boom which is closest to the mast, but located outside the zone corresponding to the articulation of the boom on the mast.

5 Claims, 14 Drawing Figures

Fig. 11
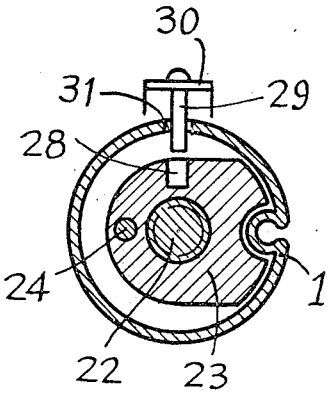
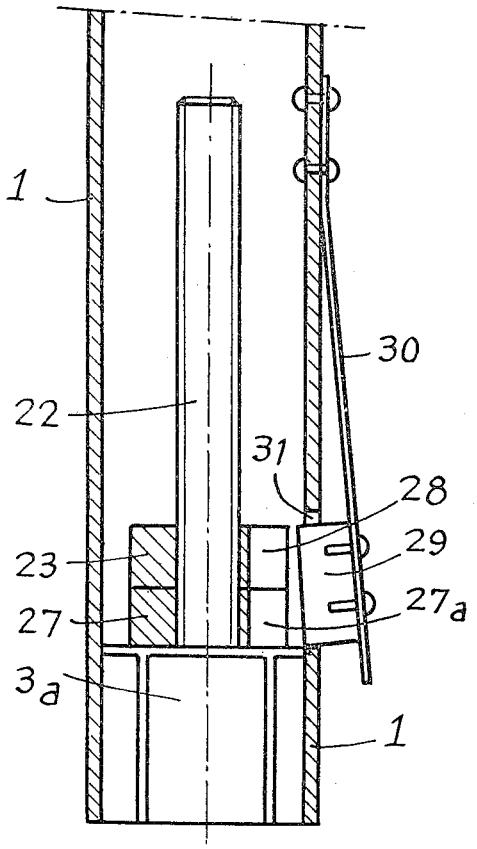
Fig. 12

DEVICES FOR SETTING A SAIL

The present invention relates to an improvement in devices for setting a sail and adapting the surface of said sail to the force of the wind.

To reduce the surface of a main sail and adapt it to the force of the wind, use is generally made of the reef-taking technique.

A second means consists, after having released the halyard, in rolling up the sail around a rolling boom actuated by a crank. This solution was currently used in the past in particular for race sailing ships, but at the present time it has practically disappeared in favor of the reef taking system which makes it possible to reduce the surface of the sail while maintaining a better shape, hence more efficient.

Examination of the mechanism of a rolling boom makes it possible to understand the reason why this system deforms the sail much more than conventional reef taking.

A boom of the type shown in FIG. 1 is connected to the mast 2 by means of a universal joint 3 which occupies a relatively substantial zone AB, from 15 to 25 cm long, depending on the size of the ship.

The luff or bolt rope 4 of the sail is engaged directly or via belaying pins in a bolt rope tunnel 5 fixed to the rear generatrix of the mast, but interrupted in C at 40 or 50 cm above the boom in order to allow the sail to follow the movements of the boom without any risk of tearing the clew 6.

The foot 7 of the sail is also engaged within the tunnel of the boom. It can be hoisted, i.e. spread between its two ends consisting of the clew 6 and the tack 8 for adapting the belly of the sail to the force of the wind.

FIG. 2 sets forth the drawbacks inherent to such usual rolling booms. When the sail is rolled up by actuation of the crank 9, it turns about the cylindrical body of the boom, but also in the zone AB occupied by the articulation; the shape and orientation of this zone varies continuously depending on the orientation of the boom. The rolled sail therefore cannot be stretched in this zone, all the more since it is necessary to roll up the reinforcement of the tack 10 (FIG. 1) and more particularly the bolt rope 4 which is usually very thick (15 to 20 mm).

In the zone close to the mast, the diameter of the rolled sail therefore increases very quickly from one turn to the following one, for example 30 mm per turn, if the bolt rope is 15 mm thick, while the diameter of the rolled sail drop increases slowly at about 2 mm per turn, which corresponds to two layers of fabric.

Due to this fact, the roll is no longer cylindrical, but strongly conical with two detrimental consequences:

the extremity of the boom progressively falls towards the deck, when rolling up about this conical mandrel, the sail is urged towards the mast, the consequence being the formation of pleats and of a belly in the sail along the mast. Due to this deformation, the sail looses its efficiency during close-hauled navigation.

The sail-rolling device according to the invention makes it possible to eliminate these drawbacks and to obtain, by merely rolling it up, a sail of reduced surface as perfect as that which could be obtained with the reef-taking system.

According to the invention, the device for setting, maintaining and rolling up a sail, of the type comprising a mast, a boom connected to the mast by a universal joint and associated with a device for driving it in rotation, and at least one bolt rope tunnel established along at least one generatrix of the mast, is characterized in that it comprises a bolt rope tunnel for the sliding and support of the said bolt rope, the bolt rope tunnel extending between the top of the mast and the point of the boom which is closest to said mast but located outside the zone corresponding to the articulation of said boom on the mast.

The following figures make it possible to precisely define the characteristics and details of the sail roller device according to the invention.

Figure 5A:
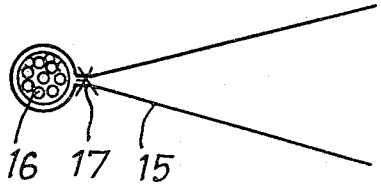
Figure 5B:
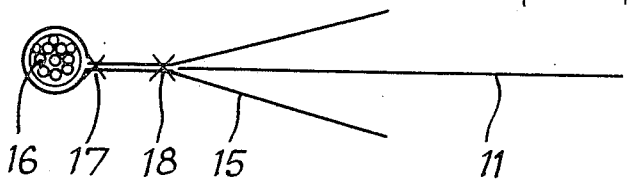
Figure 5C:
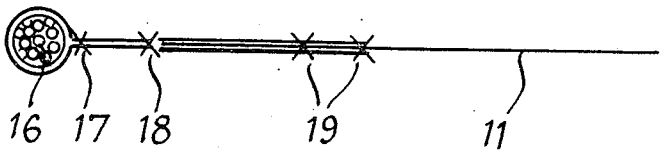

FIGS. 5*a* to 5*c* illustrate phases of embodiment of one of the elements according to the invention.

Figure 6:
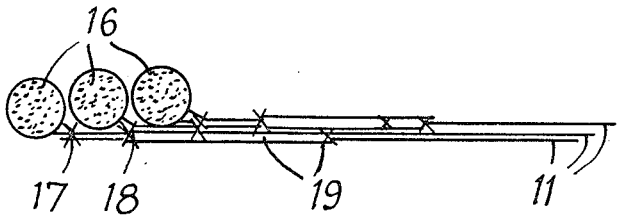

FIG. 6 is a cross-sectional view showing an advantage of the design of the subject matter of the invention.

Figure 7:
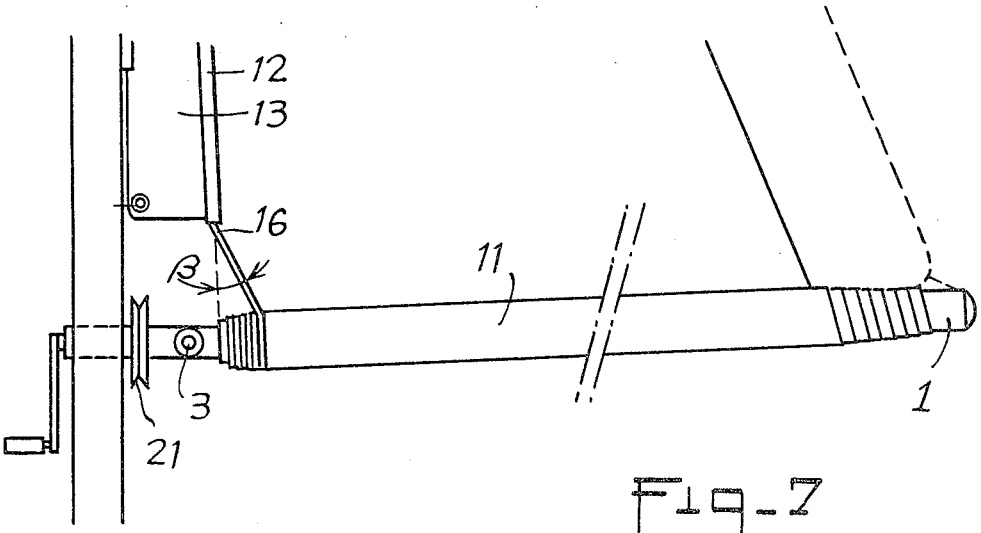
Figure 8:
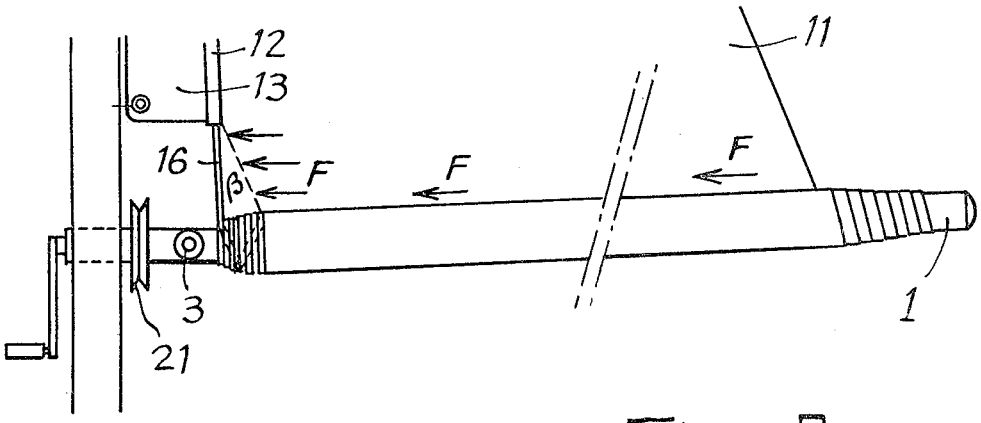

FIGS. 7 and 8 illustrate two characteristic positions of the rolling operation of a sail with the device according to the invention.

Figure 4:
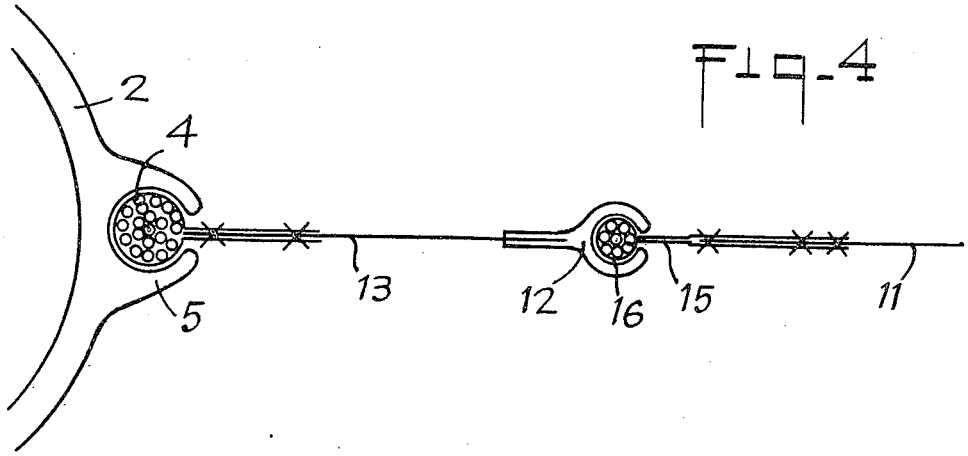
FIG. 4 shows a form of embodiment of the subject matter of the invention.
Figure 9:
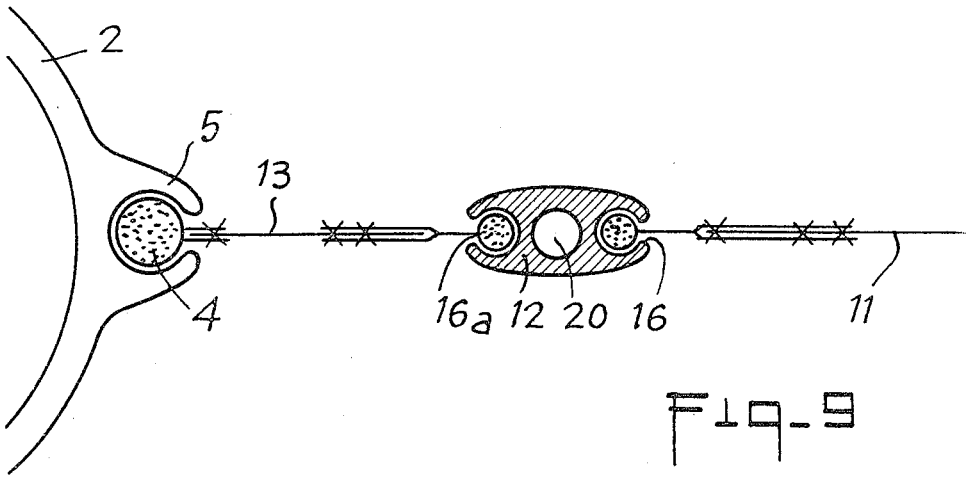

FIG. 9 shows a second advantageous form of embodiment of the element of FIG. 4.

Figure 10:
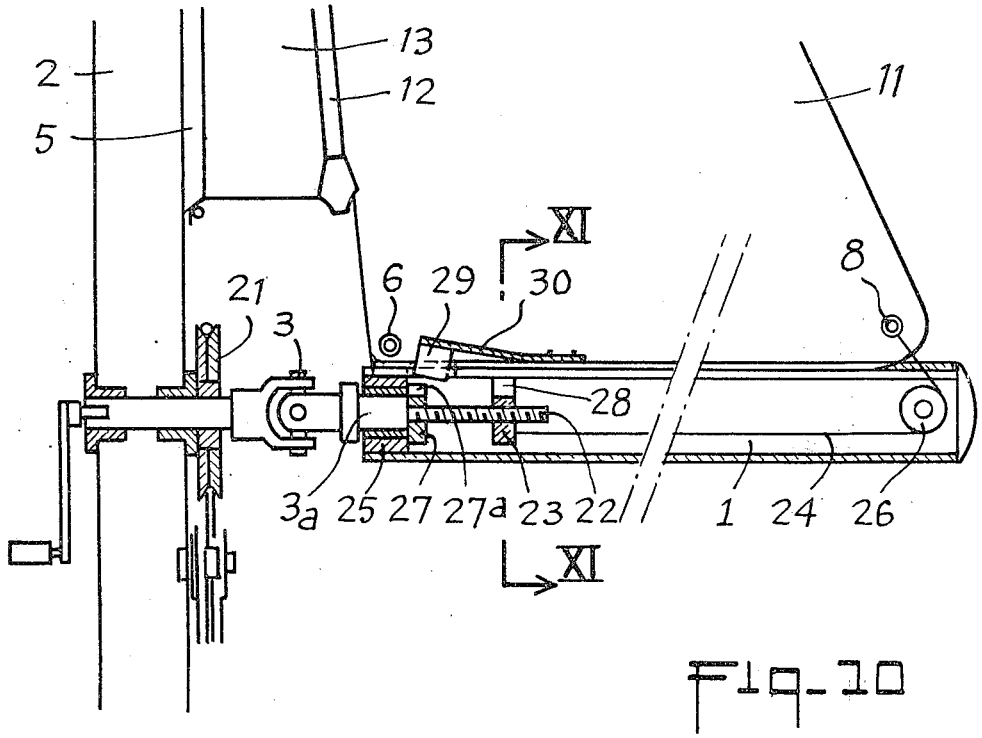

FIG. 10 is a cross-sectional view showing another arrangement of the invention with some parts shown in elevation.

FIG. 11 is a sectional view, on a larger scale, taken along line XI—XI of FIG. 10.

FIG. 12 is a cross-sectional view showing another characteristic of the invention.

As set forth previously, the problem of rolling up a sail with the conventional rolling booms results from the obligation to roll up the sail at the level of articulation 3, i.e. in the zone A-B occupied by said articulation.

Figure 1:
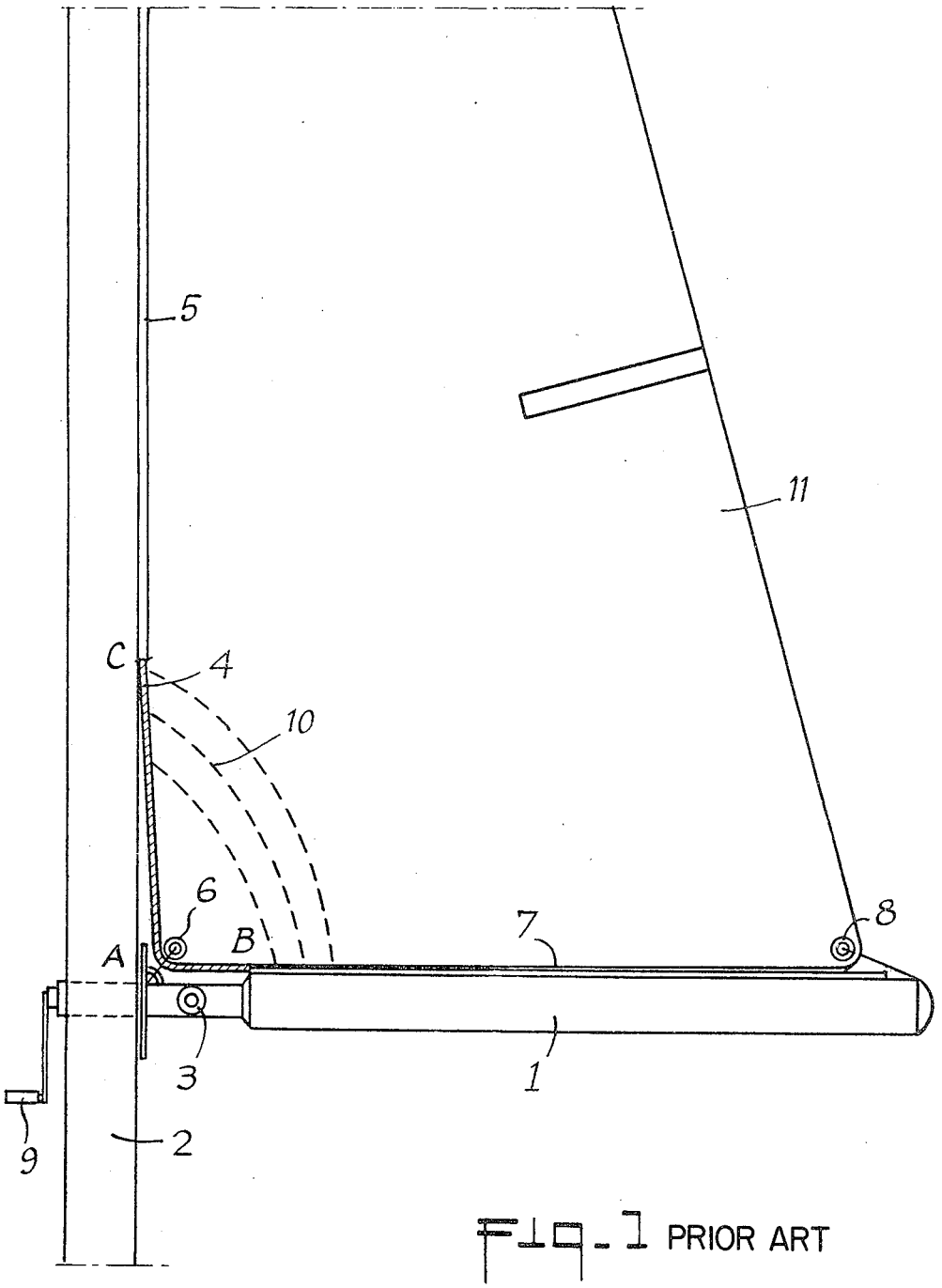
FIG. 1 PRIOR ART
FIGS. 1 and 2 are diagrammatic and partial lateral views illustrating the technique prior to the invention.
Figure 2:
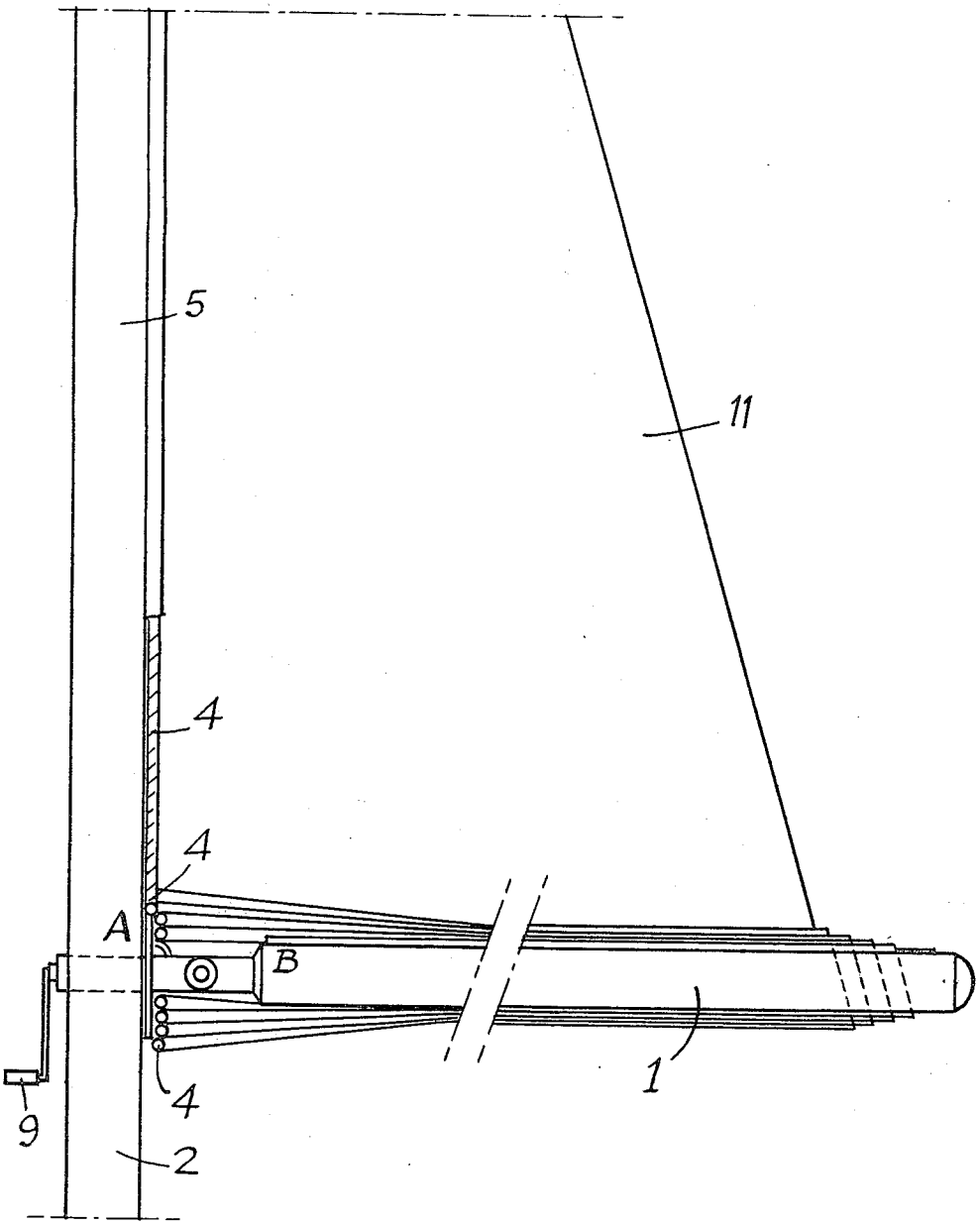
Fig. 2 PRIOR ART
Figure 3:
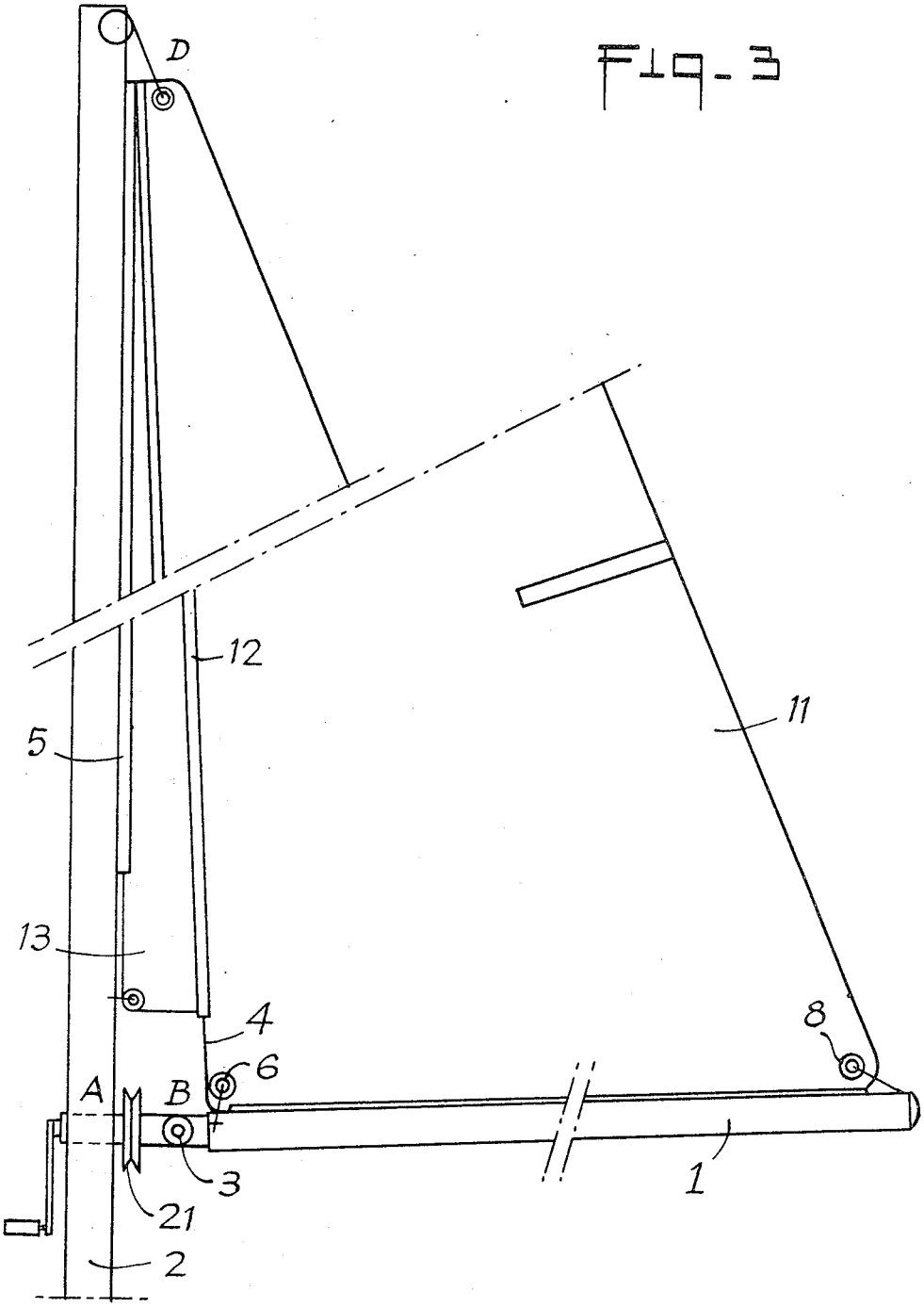
FIG. 3 is a partial elevational view showing the subject matter of the invention.

The purpose of the invention (FIG. 3) is to arrange for the zone AB to be located outside the rolling-up zone of the sail. To this end, provision is made, according to the invention, for stretching the bolt rope 4, not along the mast and against it, but directly between the head D and the extremity of the boom 1 which is closest to the mast 2.

Since the bolt rope 4 is to be sustained, it is necessary to re-establish a new bolt-rope tunnel 12 between points D and B, and to fix this tunnel by suitable means to the mast 2 itself.

A possible embodiment according to the invention consists in extending the mast 2 rearwards by a triangle 13 bearing tunnel 12 on its hypotenuse DB.

The tunnel 12 can obviously be made of any material whatsoever (light alloy, plastic) and can be connected to the mast by any suitable means.

The triangle 13 can advantageously be articulated on the rear generatrix of the mast 2 and can even be flexible so as to follow more easily the movements of the sail.

A particularly advantageous form of embodiment consists in having the triangle made with sail cloth. FIG. 4 shows in section an embodiment of this type according to which the cloth triangle 13 is limited by a bolt rope 4 introduced within the groove or tunnel 5 of the mast 2 and comprises on its opposite edge tunnel 12 in which runs the bolt rope 15 of the sail.

For forming bolt rope 15, provision is made of rope 16 imprisoned in a bolt band by means of a seam 17 stitched very close to it so as to leave no clearance (FIG. 5*a*).

In order to render more jointly liable the rope and the band, it is an advantage to cover the band with a glue containing elastomers before stitching.

The band thus obtained is completed by a second seam parallel to the first one, and distant from the latter by a space slightly greater than the diameter of the rope, for example 5 to 7 mm for a rope of 0.5 mm (FIG. 5*b*).

The cloth of the sail is introduced between the two lips of the band and assembled by a third seam 19 (FIG. 5*c*).

Experience shows that the rolling of this bolt rope on a cylindrical mandrel (or more generally on a mandrel of constant section) is effected according to a helix with joint turns (FIG. 6), the second turn coming automatically into the thinner portion which separates the two seams 17 and 18, and which is formed by two layers of cloth only against three layers between seams 18 and 19.

The direction in which the helix extends, towards the mast or towards the opposite end of the boom, depends on the angle between the axis of the boom and the axis of the bolt rope tunnel 12 at the beginning of the rolling operation.

If this angle is slightly less than 90°, the helix extends towards the free extremity of the boom. On the contrary, if it is greater than 90°, the helix extends towards the mast.

In practice, a lift, fixed at the end of the boom, will be useful for adjusting the value of this angle slightly below 90°, in such a manner that the helix extends towards the free end of the boom. As a matter of fact, the helix, when developing in this direction, pushes back slightly the cloth towards the free extremity of the boom, so that the drop of the sail can roll up freely without stress, as shown in FIG. 7.

At the end of the rolling operation, if, for example ten turns with a 5 mm bolt rope have been made, the helix will have developed on 50 mm starting from the mast and the bolt rope issuing from tunnel 12 will join the last turn under a substantial angle $\beta$, for example 20° to 30°.

When the rolling operation is completed, the boom 1 is then fixed on its axle by any means whatsoever: locking device, ratchet, brake, while the halyard is hoisted up again for rehoisting in turn the luff of the sail.

During this operation, the traction exercised on the bolt rope (FIG. 8) presses the rolled-up turns which are in some way screwed one on the other, except for the last one which, urged in an oblique direction according to angle $\beta$ by the pulling of the halyard, escapes above the adjacent turns and is aligned in the axis of the bolt rope tunnel 12.

This return of the bolt rope above the tunnel is obviously accompanied by a tractive pull on the cloth of the sail in the direction of arrow F, the said tractive pull, exercised along the boom and towards the mast, having as a consequence to stretch the foot of the sail and to flatten its base, that is to say to give to the partly rolled-up sail the ideal shape for sailing close-hauled with a strong wind.

When the connection means 13 between the mast and the new bolt rope tunnel 12 consists of a cloth triangle, it can be of interest, for forming the tunnel 12, to use a stay sheath provided with two opposite grooves, currently used for setting the jibs on the stay of a sailboat. In this case, the textile triangle is provided on its edge with a band 16*a* identical or similar to the rope 16 which forms the sail bolt rope (FIG. 9).

The term "triangle" is not limitative. It only corresponds to the example selected for illustrating the invention. It is obvious that this connecting member 13 can be given any shape whatsoever: trapezium or rectangle, without departing from the scope of the invention, provided with the new bolt rope of sail 16 reaches the boom outside zone AB occupied by the mechanism.

The central channel 20 of the sheath supporting the two tunnels will advantageously be used for housing a rope, fixed at the top of the mast, which will support the weight of tunnel 12 and the connecting member 13.

The above-described sail roller system can operate with any one of the boom roller systems already known.

For example, boom 1, articulated to mast 2 via a universal joint 3, can be driven by a simple crank directly engaging with the axle of the universal joint.

In a more elaborated form, driving is effected by a notched pulley 21 fixed to the axle of the universal joint passing through the mast and driven by a reciprocal motion of the rope with extension in the cockpit so as to centralise the operations in the vicinity of the control station.

Before reducing the surface of a sail it is necessary to stretch the foot thereof to the maximum.

In the case in which reducing of the surface of the sail is effected by rolling it up about the boom, it would be of interest to have the two functions: hoisting and rolling effected by one single mechanism.

According to a second aspect resulting from the invention, this problem can be solved from the moment on which the sail is rolled up without pleats on the boom by the presence of tunnel 12. In fact, according to FIGS. 10 and 11, provision is made for extending part 3*a* of the joint 3 so that it can freely swivel in the bottom 25 of boom 1. Beyond bottom 25, part 3*a* extends into a screw 22 driving in translation, along the axis of the boom, a slide 23 to which is connected a cable 24 passing at the end of the boom on a return pulley 26 to join the eye of the clew 8 of sail 11.

When nut 23 is completely unscrewed, the foot of the sail is released to a maximum. On the contrary, when it is completely screwed in contact with the seating 27 of the screw 22, the foot of the sail is stretched to a maximum.

In this position, if the axle of the universal joint continues to rotate, the slide-nut 23 cannot move back any longer and therefore necessarily drives the boom in its movement of rotation about the axle. It is merely necessary for rolling up the sail to release the halyard for continuing this motion.

As shown in FIG. 8 however, the re-hoisting of the main sail bolt rope after winding will have a tendency to release the slide-nut 23 which should be blocked on its seating by means of a locking system which can be easily released from the exterior.

According to the invention, this locking system is automatically controlled by the rolling-up of the first turn of the sail. To this end, the nut 23 is cut radially and axially in order to define a recess 28 of rectangular section, having its homologue 27*a* on the bearing 27. Opposite this recess 28, a rectangular opening 31 is provided in the wall of the boom for the passage of a locking device 29 maintained by a spring blade 30 in such a manner that in the rest position, it projects externally at least partly, by about 10 mm, and at the same time releases the recesses 27*a* and 28.

When the sail starts rolling up, it progressively presses the spring blade 30 and applies it against the external wall of the boom. This causes penetration of the locking device 29 in the recesses 28 and 27*a* and renders said locking device in locking engagement with the nut 27.

After the sail is completely unrolled, the locking device may sometimes not have been released spontaneously if it remains jammed in its recess, but it will be released as soon as the universal joint axle is actuated in the unrolling direction with the precise purpose of releasing the stretching of the sail foot.

By virtue of this combination comprising recesses 27*a* and 28, the locking device 29 and spring 30, the locking and releasing of the boom on the universal joint axle become entirely automatic.

It is obvious that the shape and position of recess 28, locking device 29 and spring 30 can be modified as desired without departing from the scope of the invention as long as the closing and opening of the locking system (locking device, key, ratchet) are controlled by mere rolling or unrolling of the sail on the periphery of the boom.

What is claimed is:

1. A device for setting, maintaining and rolling up a sail of the type comprising a mast, a boom connected to the mast by a universal joint and associated with a device for driving it in rotation and at least one bolt rope tunnel extending generally along and spaced from the mast to receive a bolt rope borne by the corresponding edge of the sail wherein said bolt rope tunnel extends from the head of the mast toward a point of the boom which is located outside the universal joint with respect to the mast, said bolt rope tunnel being borne by a connecting member mounted on said mast for rotation about a vertical axis and extending over the area between the mast and said bolt rope tunnel.

2. A device according to claim 1 wherein the connecting member consists of a part mounted by means of a bolt rope in a further bolt rope tunnel on and extending along the mast, said part carrying the bolt rope tunnel of the sail.

3. A device according to claim 2 wherein the edge of said connecting member opposite to the mast comprises a double groove bolt rope tunnel.

4. A device according to claim 1 wherein the connecting member bears a bolt rope tunnel receiving a bolt rope of the corresponding edge of the sail, said bolt rope being connected to the edge of the sail by a flexible member having a width slightly larger than the cross section of the rope itself secured to said sail along an edge zone thereof and a thickness which is less than that of said zone.

5. A device according to any one of claims 1, 2 or 4 comprising: a swivel formed as part of said universal joint and passing freely through the corresponding end of the boom, a stop member in said boom, said swivel extending inside said end and beyond the seating of a stop member, a screw cooperating permanently with a guided nut retaining the end of a rope which is also fixed to a clew of the sail, said stop and the nut being provided in their peripheral surface with recesses intended, when they are aligned, to receive a locking device carried by a resilient arm fixed on the boom so that said locking device is urged in the direction of engagement with the recesses of said stop and nut in response to rolling up of the sail on the boom.

* * * * *